United States Patent [19]

Potter

[11] Patent Number: 5,039,101

[45] Date of Patent: Aug. 13, 1991

[54] RANDOM NUMBER GENERATOR

[76] Inventor: Clinton Potter, 1012 Aloha Dr., Encinitas, Calif. 92024

[21] Appl. No.: 584,787

[22] Filed: Sep. 19, 1990

[51] Int. Cl.[5] ..... A63F 3/06

[52] U.S. Cl. ..... 273/144 B; 273/457

[58] Field of Search ..... 273/144 B, 144 R, 1 L, 273/145 C, 145 CA, 109

[56] References Cited

U.S. PATENT DOCUMENTS

| | | | |
|---|---|---|---|
| 806,255 | 12/1905 | Hughes | 273/1 L |
| 3,423,872 | 1/1969 | Dodson | 273/144 B |
| 4,403,775 | 9/1983 | Chaput | 273/144 B |
| 4,874,178 | 10/1989 | Gage | 273/144 B |

FOREIGN PATENT DOCUMENTS

| | | | |
|---|---|---|---|
| 2382059 | 10/1978 | France | 273/144 B |
| 2127306 | 4/1984 | United Kingdom | 273/1 L |

*Primary Examiner*—Benjamin Layno

*Attorney, Agent, or Firm*—Frank D. Gilliam

[57] ABSTRACT

The invention is directed to a random number generator for selecting a specific quantity of random numbers from a preselected quantity of numbers for a selected game of chance. A plurality of numbered spheres are contained in a hollow transparent container. The container is substantially filled with the plurality of spheres and a liquid. The spheres are buoyant relative to the liquid. A hollow tube having a diameter slightly larger than the diameter of the spheres and a length which is a multiple of the diameters of a predetermined number of spheres extends from the container. The hollow portion of the tube communicates with the hollow portion of the container so that when a tube is positioned above the container a selected quantity of spheres from the container "float" into the tube and form a column of spheres therein. The numbers on the spheres are then read to determine a set of random numbers for playing a game of chance, namely, a lottery. The random number generator also includes a transparent cover which covers the tube and connects to the container. In a second embodiment hollow tubes extends from opposites sides of the container each for the same purpose as in the first embodiment.

14 Claims, 1 Drawing Sheet

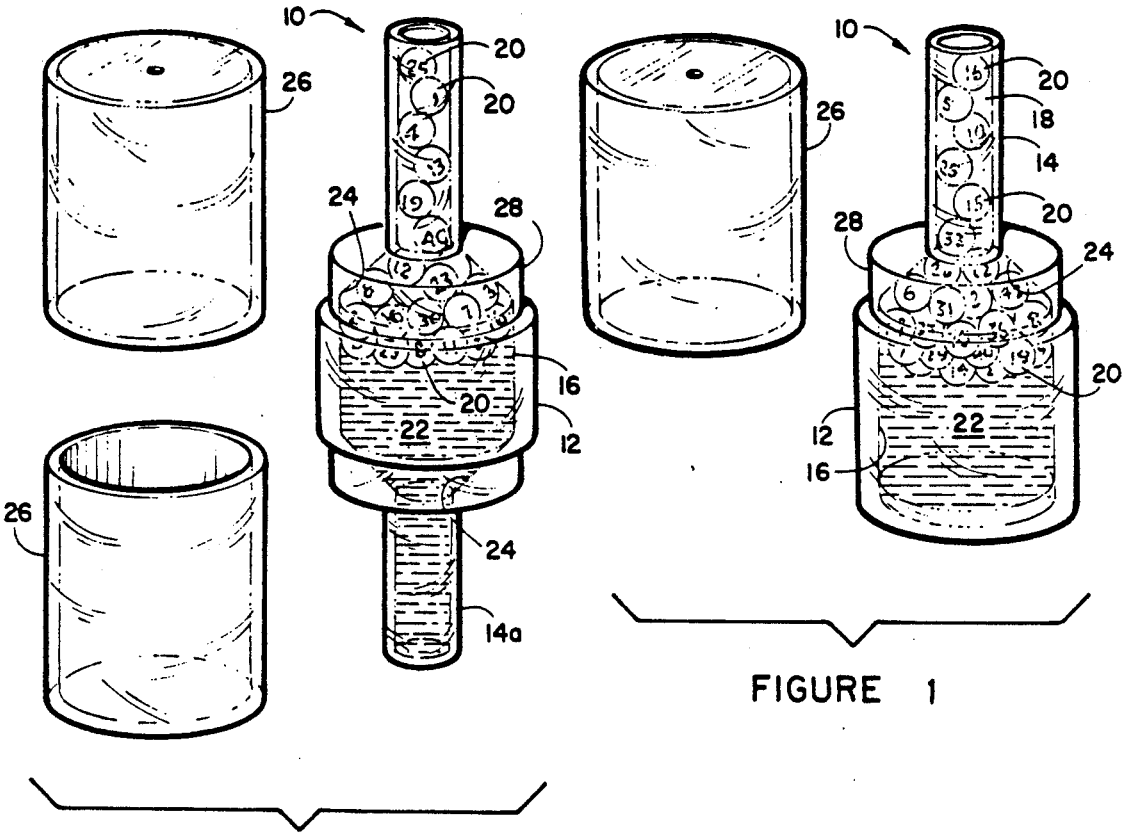
FIGURE 1
FIGURE 2
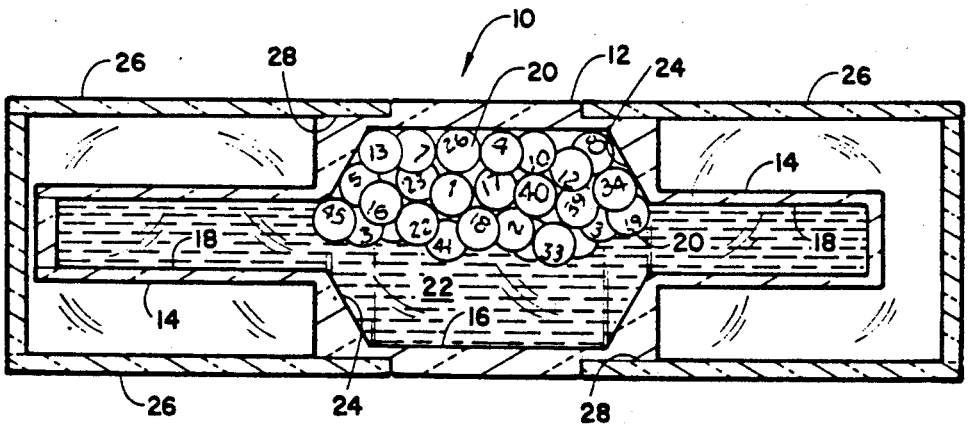
FIGURE 3

RANDOM NUMBER GENERATOR

BACKGROUND OF THE INVENTION

The invention is directed to a manually manipulated random number generator for the playing of a game of chance, and more particularly to a mechanical random number generator in which only a predetermined number of random numbers can be chosen from a predetermined series of numbers.

In the playing of lottery and especially the playing of state lotteries in the United States a specific total of numbers from a specific field of numbers is randomly chosen to determine the winner. As for example in the State Lottery of California six principle numbers and a seven alternate number are chosen from a field of 53 possible numbers. The winning selection of numbers can win large quantities of money relative to the cost of a lottery ticket.

There are numerous random number generators in the prior art. The prior art random number generators select numbers from an infinite number of available numbers. An example of random number generators can be found in the following U.S. Pat Nos.: 4,692,863; 3,674,275 and 2,396,475. U.S. Pat. No. 4,692,863 by inventor Moosz teaches a complex electronic random number generator for lottery games. A processor and memory randomly generate combinations of stored numbers. U.S. Pat. No. 3,674,275 teaches a base member with a plurality of compartments each is assigned a number. A ball dropped into a centrally positioned slot against a deflector can randomly directed the ball into a numbered slot. The total number of slots and accordingly the amount of different numbers possible are limited to the size of the device.

None of the above listed random number generators select a specific number of random numbers from a predetermined field of total numbers or are manually manipulated.

There has not been a simple inexpensive random number generator that can select the required numbers for a State lottery from a field of numbers limited to that lottery until the emergence of the present invention.

SUMMARY OF THE INVENTION

The random number generator of the present invention comprises a hollow central body portion or container and a hollow tubular extension the hollow portions of which communicates with the hollow portion of the container. The container is substantially filled with a plurality of spheres of a predetermined number sequence and a liquid in which the spheres are buoyant. The hollow portion of the tube has a diameter slightly larger than the diameter of the spheres and has a length which is a multiple of the diameter of the spheres so that a selected number of spheres will fit into the hollow portion of the tube. In operation, the spheres are positioned in the container and then the device is rotated so that the tube is above the container. The spheres will then due to their buoyancy "float" up into the tube where they are columnated. The number from those spheres then can be used to play lottery or other games of chance using a give quantity of numbers. In a second embodiment, tubes are located a different ends of the container and can have different or the same lengths and the device operates in the same manner as discussed above.

An object of this invention is to provide a device for randomly selecting the numbers to be used in a selected State lottery.

Another object of the invention is to provide an inexpensive hand held random number generator for selecting a plurality of numbers for a selected State lottery.

Still another object of this invention is to provide a random number generator for use for simultaneously selecting a plurality of numbers for use in a game of chance.

Other objects and advantages of this invention will become apparent from the following description taken in conjunction with the accompanying drawings wherein are set forth, by way of illustration and example, certain embodiments of this invention.

BRIEF DESCRIPTION OF THE DRAWING FIGURES

FIG. 1 depicts a first embodiment of the random number generator of the invention;

FIG. 2 depicts a second embodiment of the random number generator of the invention; and FIG. 3 depicts a showing of the random number generator of FIG. 2 with end covers in place for storage.

DETAILED DESCRIPTION OF THE PREFERRED EMBODIMENTS

Referring now to the various drawing Figures and specifically to drawing FIG. 1 which depicts a first embodiment of the random number generator 10 of the invention. The device 10 comprises a hollow body or container 12 with a hollow tube 14 extending from the body portion. The tube is shown centrally positioned on one surface of the body portion. The hollow portion 16 of the container communicates with the hollow portion 18 of the tube. The body portion and tube are shown, by way of example and not by way of limitation, to be cylindrical in cross-section.

The hollow portions of the body portion and tube are substantially filled with a plurality of spheres 20 each having a preselected number from a preselected series of numbers thereon and a liquid 22 in which the spheres 20 are buoyant. The spheres can be constructed of plastic or the like either with hollow or solid centers. The only requirement of the construction material of the spheres is that they are buoyant in the liquid in the hollow portions. The liquid in the hollow portions may be water, alcohol, light oil or the like.

The cross-section of the tube is slightly larger than the diameter of the spheres so that when filled with spheres the spheres are in a stacked position in the hollow section of the tube. The length of the tube is determined by the number of spheres (six shown) to be contained by the hollow portion of the tube. This length can be selected to accommodate the number of spheres that represent the total number of numbers used to play the lottery or selected game of chance.

A transition area 24 (seen clearly in drawing FIG. 3) having a funnel like shape transition between the larger cross-section of the body portion 12 and the smaller diameter tube 14. This transition are allows for a smooth movement of the spheres between the hollow portion of the body portion and the hollow portion of the tube. A cover 26 is used to enclose the tube 14 to prevent disengagement from the body portion in the event the device 10 is dropped or has rough handling, see FIG. 3. The cover frictionally attaches to a reduced diameter portion 28 at the end of the body portion on which the tube is attached.

The body portion, tube and cover are constructed of a transparent material so that the numbers on the spheres can be read from the exterior of the device. The device may be constructed from, for example, plastic or the like which is suitable for the purpose intended.

In operation, the spheres are positioned within the body portion by positioning the device on its side or the like to so that no spheres remain in the tube. The device is then positioned with the tube elevated above the body portion at which time the buoyant spheres "float" into the tube. When the tube is filled with numbers in a stacked column, the selected numbers are then used to play lottery or other games of chance.

In the embodiment of FIG. 2, a second hollow tube 14*a* shown extending from the opposite side of the body portion from the tube 14. Tube 14*a* is used for the same purpose as tube 14. Tubes 14 and 14*a* can be of different lengths to capture a different quantity of numbered spheres if desired. This feature allows the random selection of numbers for lotteries or other games of chance using different quantities of numbers for play. The device includes a pair of covers 26 which are shown in place on the body portion in FIG. 3. The device shown in FIGS. 2 and 3 operates in the same manner as described above.

It should be understood that although the intent is to use all of the numbers selected, i.e. six total in California, other amounts may be used to play games other than lottery such as, for example, certain card games and the like.

The liquid and tube act as a magnifier to enhance the reading of the numbers on the spheres.

The selection of additional random numbers can be made by repeating the manipulation of the device.

It is to be understood that while certain forms of the present invention have been illustrated and described herein, it is not to be limited to the specific forms or arrangement of parts described and shown.

What is claimed is:

1. A random number generator comprising:

a hollow body portion;

a first hollow tube extending from said body portion, the hollow portions of said body portion and tube having communications;

a cover for said tube, said cover connects to said body portion; and a plurality of different numbered spheres of substantially uniform diameter and a liquid in which the spheres are buoyant substantially filling said hollow portions of said body portion and said tube, said hollow portion of said tube having a diameter slightly larger than the diameter of said spheres and a length substantially equal to the total cumulative diameters of a selected total number of spheres whereby when said tube now containing no spheres is elevated above said body portion a selected number of spheres randomly fill said tube in a stacked fashion.

2. The random number generating device of claim 1 wherein said tube is centrally positioned on one surface of said body portion.

3. The random number generator of claim 1 additionally comprising a second hollow tube with the hollow portion in communication with the hollow portion of said body portion, said hollow tube is of a different length than said first hollow tube in order for second hollow tube to hold a different number of spheres in a stacked fashion than said first hollow tube.

4. The random number generator of claim 3 wherein the hollow portion of said body portion has a greater diameter than said the hollow portion of said tubes and additionally comprises a transition means positioned between the hollow portion of said hollow body portion and the hollow portions of said first and second hollow tubes whereby the larger dimension of said hollow portion of said body portion gradually reduces in diameter longitudinally to the reduced diameter of said hollow portion of said first and second hollow tubes.

5. The random number generator of claim 1 wherein plurality of spheres number fifty five.

6. The random number generator of claim 1 wherein said tube holds six stacked spheres.

7. The random number generator of claim 1 additionally comprises a second tube extending from the body portion opposite said first hollow tube.

8. The random number generator of claim 1 wherein said liquid is selected from a group consisting of water, alcohol and light oil.

9. The random number generator of claim 1 wherein said tube and body portions are transparent.

10. The random number generator of claim 1 wherein said cover is transparent.

11. The random number generator of claim 1 wherein the hollow portion of said body portion has a greater diameter than said the hollow portion of said tubes and additionally comprises a transition means positioned between said hollow body portion and the hollow portion of said hollow tube whereby the larger dimension of said hollow portion of said body portion gradually reduces in diameter longitudinally to the reduced diameter of said hollow portion of said first hollow tube.

12. The random number generator of claim 11 wherein said transition means is in the shape of a frusto conic section.

13. The random number generator of claim 11 wherein said transition means is in the shape of a frusto conic section.

14. A random number generator comprising:

a hollow body portion;

a first hollow tube extending from said body portion, the hollow portions of said body portion and tube having communications;

a second hollow tube with the hollow portion in communication with the hollow portion of said body portion, said second hollow tube is positioned opposite said first hollow tube;

a pair of transparent covers, one for covering each of said hollow tubes, said covers being removably connectable to said body portion; and a plurality of different numbered spheres of substantially uniform diameter and a liquid in which the spheres are buoyant substantially filling said hollow portions of said body portion and said tubes, said hollow portion of said tubes having a diameter slightly larger than the diameter of said spheres and a length substantially equal to the total cumulative diameters of a selected total number of spheres whereby when said tubes now containing no spheres is elevated above said body portion a selected number of spheres randomly fill said tubes in a stacked fashion.

* * * * *